US012195925B2

(12) United States Patent
Holloway et al.

(10) Patent No.: US 12,195,925 B2
(45) Date of Patent: Jan. 14, 2025

(54) METHOD, APPARATUS AND SYSTEM FOR LIFTING RAILROAD STRUCTURES

(71) Applicant: ENERPAC TOOL GROUP CORP., Menomonee Falls, WI (US)

(72) Inventors: Eric Holloway, Boise, ID (US); Jeremy Thompson, Boise, ID (US)

(73) Assignee: ENERPAC TOOL GROUP CORP., Menomonee Falls, WI (US)

( * ) Notice: Subject to any disclaimer, the term of this patent is extended or adjusted under 35 U.S.C. 154(b) by 927 days.

(21) Appl. No.: 17/229,819

(22) Filed: Apr. 13, 2021

(65) Prior Publication Data

US 2021/0317615 A1 Oct. 14, 2021

Related U.S. Application Data

(60) Provisional application No. 63/009,351, filed on Apr. 13, 2020.

(51) Int. Cl.

| | |
|---|---|
| ***E01B 27/10*** | (2006.01) |
| ***E01B 29/04*** | (2006.01) |
| *E01B 27/13* | (2006.01) |

(52) U.S. Cl.
CPC ..... *E01B 27/105* (2013.01); *E01B 29/04* (2013.01); *E01B 27/13* (2013.01); *E01B 2203/015* (2013.01); *E01B 2203/10* (2013.01)

(58) Field of Classification Search
CPC ..... E01B 7/28; E01B 27/105; E01B 27/18; E01B 27/13; E01B 29/04;
(Continued)

(56) References Cited

U.S. PATENT DOCUMENTS 2,996,016 A 3/1957 Keller
3,012,403 A * 12/1961 Westcott, Jr. ..... B66F 3/42
(Continued)

FOREIGN PATENT DOCUMENTS

CN 201574007 U * 9/2010
CN 207918339 U * 9/2018
(Continued)

OTHER PUBLICATIONS

Track Tools, LLC; International Search Report; PCT/US 21/27170; international filing date Apr. 13, 2021; earliest priority date Apr. 13, 2020.

*Primary Examiner* — Zachary L Kuhfuss
*Assistant Examiner* — Heaven R Buffington
(74) *Attorney, Agent, or Firm* — ANDRUS INTELLECTUAL PROPERTY LAW, LLP

(57) ABSTRACT

A system and method for use in raising the height of railroad structures. Railroad structures are defined as the structures where two or more railway tracks merge, cross, or divide. The method utilizes excavating an opening beneath a railway track at or adjacent to a railroad structure. A hydraulic jack is positioned within the opening. This is repeated until sufficient hydraulic jacks have been positioned around the structure. The hydraulic jacks are then actuated to raise the railroad structure to a desired height. Generally this height provides a slight crown to the structure. Ballast is then positioned beneath the raised railway. The hydraulic jacks can be disconnected from the hydraulic lines and left in position, or removed. Preferably the hydraulic jacks are positioned on hydraulic jack sleds for improved ease in transporting the hydraulic jacks and to provide a platform on which the hydraulic jack is slid into and out of the opening beneath the railway. An apparatus is provided for use in raising a railroad structure. The apparatus utilizes a hydraulic pump and motor positioned on a frame. Hydraulic fluid
(Continued)

is selectively provided through a manifold to the hydraulic jacks, or to one or more remote manifold(s) either directly or through the manifold. Hydraulic jack sleds are provided that are preferably configured for storage and transport on the frame.

9 Claims, 5 Drawing Sheets

(58) Field of Classification Search
CPC ..... E01B 2203/015; E01B 2203/10; E01B 27/00; E01B 27/025; E01B 29/00; E01B 29/09; E01B 29/22; E01B 29/40; E01B 33/00; E01B 33/04; B66F 3/42; B66F 3/25; B66F 3/24; B66F 2700/05
USPC ..... 104/2
See application file for complete search history.

(56) References Cited

U.S. PATENT DOCUMENTS

| | | | | |
|---|---|---|---|---|
| 3,119,346 | A | 1/1964 | Derler | |
| 4,464,995 | A | 8/1984 | Nameny | |
| 4,947,757 | A | 8/1990 | Theurer | |
| D610,773 | S * | 2/2010 | Stanton | D34/31 |

FOREIGN PATENT DOCUMENTS

| | | | | |
|---|---|---|---|---|
| DE | 4101432 | A1 | 7/1992 | |
| KR | 100555247 | B1 * | 3/2006 | |
| KR | 100749800 | B1 | 8/2007 | |
| KR | 20170002828 | A * | 1/2017 | B66F 3/25 |

* cited by examiner

METHOD, APPARATUS AND SYSTEM FOR LIFTING RAILROAD STRUCTURES

PRIORITY/CROSS-REFERENCE TO RELATED APPLICATIONS

This application claims the benefit of U.S. Provisional Application No. 63/009,351, filed Apr. 13, 2020, the disclosure of which is incorporated by reference.

TECHNICAL FIELD

The disclosure generally relates to the field of railroad maintenance. Particular embodiments relate to a method, apparatus and system for lifting railroad structures, namely lifting sunken railroad structures to allow for replacement of ballast beneath the structures.

BACKGROUND

Railroad tracks are typically comprised of two spaced apart parallel tracks that are configured for the rail wheel of a railroad vehicle, such as a train. The rails are connected to ties, also called sleepers, that span in a generally perpendicular orientation between the rails. Each tie is typically connected to each rail by a tie plate connected to the rail and connected to the tie by several fasteners, typically called spikes. The ties and rails are positioned on a bed of a ballast of crushed rock overlaying a base. The ballast is typically comprised of a crushed rock, such as granite.

The location where two or more railroad tracks intersect, merge, or divide is referred to herein as a structure. Railroad structures including diamonds, frogs, switches and other railroad structures used to facilitate the crossing, merging, and separation of two or more railroad tracks. The intersection of multiple tracks in a location leads to increased use of that location as trains on each multiple trains from multiple directions. This increases the weight that is placed upon each structure in comparison to a single set of tracks. This increased use typically causes the structures to sink relative to the single tracks leading to the structure as the ballast beneath the structure is compacted or worn. The sinkage rate varies, but structures often need to be raised as often as three to four times per year.

Typical methodology used to raise a structure and to return to level or nearly level with surrounding track is to utilize a crane, side boom crawler, or excavator, and to lift the track and then to replenish the ballast manually beneath the track. This ballast replacement method does not allow for typical ballast filling vehicles, that travel on the railroad track and use arms to fill ballast on the track beneath it, and instead requires manual labor with limited machine assistance. While this process returns the structure to an acceptable height, it can be difficult to obtain a true level with the track leading into and out of the structure and requires a significant amount of time and labor to achieve. Further, rail traffic across the railroad structure must be delayed while the process is used. This delay can cost a significant amount of money in lost transport time. What is needed is a method and/or system that can be utilized to reduce the amount of time and manual labor required to level a structure or to bring it to a crowned position to allow for additional time between leveling, as well as a method and/or system that allows for continued use of the railway while the leveling process occurs.

SUMMARY

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a method and system for returning a railroad structure to level, or even with an upward crown that allows for continued use of the railroad while the process is occurring and facilitates a reduction of time and resources needed to return the railroad structure to a level position. In a preferred embodiment the method involves the step of excavating an opening beneath a rail forming a part of or adjacent to a railroad structure such that a hydraulic jack can be positioned beneath the rail of the structure or beneath rail adjacent to the structure. Alternatively a tie can be removed with the jack positioned in the opening resulting from removal of the tie. The tie removal involves removing the fastener attaching each rail to the tie and sliding or pulling the tie from beneath the rail.

A hydraulic jack is then positioned beneath the rail. The step is repeated sufficiently around the structure such that the hydraulic jacks can be utilized together to lift the entirety of the structure. Preferably the hydraulic jacks are each hydraulically connected to a hydraulic pump. The hydraulic jacks are preferably connected to the hydraulic pump at a manifold. The manifold preferably has independently operated valves for each jack. The manifold can be located proximate to the pump or remotely from the pump. In a preferred embodiment four hydraulic jacks are utilized to move a structure, although fewer or additional jacks can be utilized. In a preferred embodiment the jacks are labeled with an indicator, such as a flag, tag, or color applied to the jack, that corresponds with a color at the manifold such that a user can actuate the correct valve for the correct jack. Preferably each hydraulic jack is positioned within a sled configured for placement in the opening beneath the railway.

After each hydraulic jack is positioned beneath the rail proximate to or at the structure, the hydraulic jacks are actuated to lift the structure to preferably at or above its original height to either level the structure or provide a crown to the structure. A railroad level is typically placed across the structure. The railroad level is a standard tool in the railroad industry and typically measures track gauge and superelevation. Typically, the structure is raised and leveled by selectively actuating each jack, checking for level, and raising and lowering each jack until the desired level is achieved. Another frequently used measurement tool is a "rail run-off" or sting line tool.

After the structure is lifted to its desired elevation, the operator preferably disconnects each jack from the hydraulic pump. The ends of the hydraulic lines connected to each jack can then be connected together to prevent debris from entering the fittings on the lines and prevent damage to the fittings and line. The jacks utilized preferably have counter balance valves and thus remain lifting the structure. A tamper machine traveling on the track is then brought across the rail to the structure that has been lifted. The tamper machine squeezes and tamps ballast under the elevated railway. The level of the structure is then checked again. The jacks are then hydraulically connected to the hydraulic pump. If the structure is not level, the jacks can again be utilized to lift the structure, followed by tamping of ballast by the tamping machine. Once suitable level is achieved, the jacks can be depressed and removed, and ballast installed in the opening from which the jack is removed. Alternatively the hydraulic jacks can be left in position for future use.

The hydraulic jacks have been positioned such that in can be utilized to lift the structure in coordination with jacks similarly positioned around the structure. Lifting of the structure with multiple high capacity hydraulic jacks allows for a tamping machine to replenish the ballast beneath the track while traveling on the track. After the tamping machine has replaced the ballast along the track but for covering the opening(s), the hydraulic jacks are removed, the tie is replaced, and the ballast is replenished beneath the railroad tie this allows for the structure to be lifted to its original position, or higher to establish a crown to allow for longer duration of time between ballast replacement. Other on track machines include brooms, excavators, and backhoes that have hi-rail wheel attachments and can be utilized on the track while the jacks are in place.

In a preferred embodiment a hydraulic pump is provided that is mounted to a frame and configured for selective actuation via one or more manifolds of the hydraulic jacks. The frame is configured to be movable, preferably by a forklift and/or hoist or crane. Alternatively the frame can be integrated into a vehicle bed or trailer. The frame is also designed so that it may be pulled or winched into an appropriate trackside position.

What is further disclosed is a system to be utilized in the raising of railroad structures. The system has a frame on which a hydraulic pump and preferably a manifold configured for the selective actuation of multiple hydraulic jacks that are connected by hydraulic lines to the manifold. The hydraulic pump is in fluid connection to a hydraulic fluid reservoir and driven by a motor. This power unit or motor may be electric or internal combustion in operation. The pump pumps hydraulic fluid through the manifold to actuate hydraulic jacks in hydraulic connection with the manifold. Preferably the manifold is configured for hydraulic connections to establish four hydraulic circuits, although varying or additional manifold extensions can be utilized. A series of hydraulic lines for providing hydraulic pressure to the hydraulic jacks. In a preferred embodiment the frame has mounted thereto a hydraulic hose reel for extending and retracting hydraulic line to the jacks. Placement of jacks beneath the rails of the railroad track combined with the process of actuating jacks from below allows the use of the equipment and the tracks without necessitating the disruption of train traffic. Typically, trains will continue to operate under a slow order, but are not stopped.

The frame is preferably configured with a manifold hydraulically connected to the hydraulic pump. The manifold is configured to selectively actuating hydraulic jacks that are in hydraulic connection with the manifold. The manifold has an outflow port and an inflow port for each connection for each jack and an independent valve for each hydraulic outflow to allow for selective actuation of each hydraulic jack. Each valve can be manually operated or electronically operated, including remote operation. The remote operation system may use a transponder, receiver, or radio-frequency controlled mechanism using a separate control box.

Preferably the frame has a jack mounting plate configured for mounting the hydraulic jacks for facilitating transport of the system. The frame can further be configured for mounting of additional spare hydraulic lines. The frame preferably is configured with a hydraulic hose reel for storage of hydraulic line used for hydraulically connecting the hydraulic jacks to the hydraulic pump.

In a preferred embodiment the manual valves of the manifold are color-coded or number-coded to coordinate with a color-coded jack or a color coded flag that allows for communication between a worker approximate to the jack and the operator of the manifold. For example, an orange flag can be utilized with a manifold lever painted orange such that the worker can indicate to the manifold operator to activate the orange coded manifold valve. While the depicted embodiment utilizes a manual lever for each connection, electronic (such as solenoid valve) or other computerized control can be utilized, including remote operated valves. The manifold and pump can be configured with remote operation, such as with a remote control, control via the internet, and/or control via local network. Each individual hydraulic jack is operated as a double acting cylinder with an integrated counter balance valve.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE FIGURES

Figure 1:
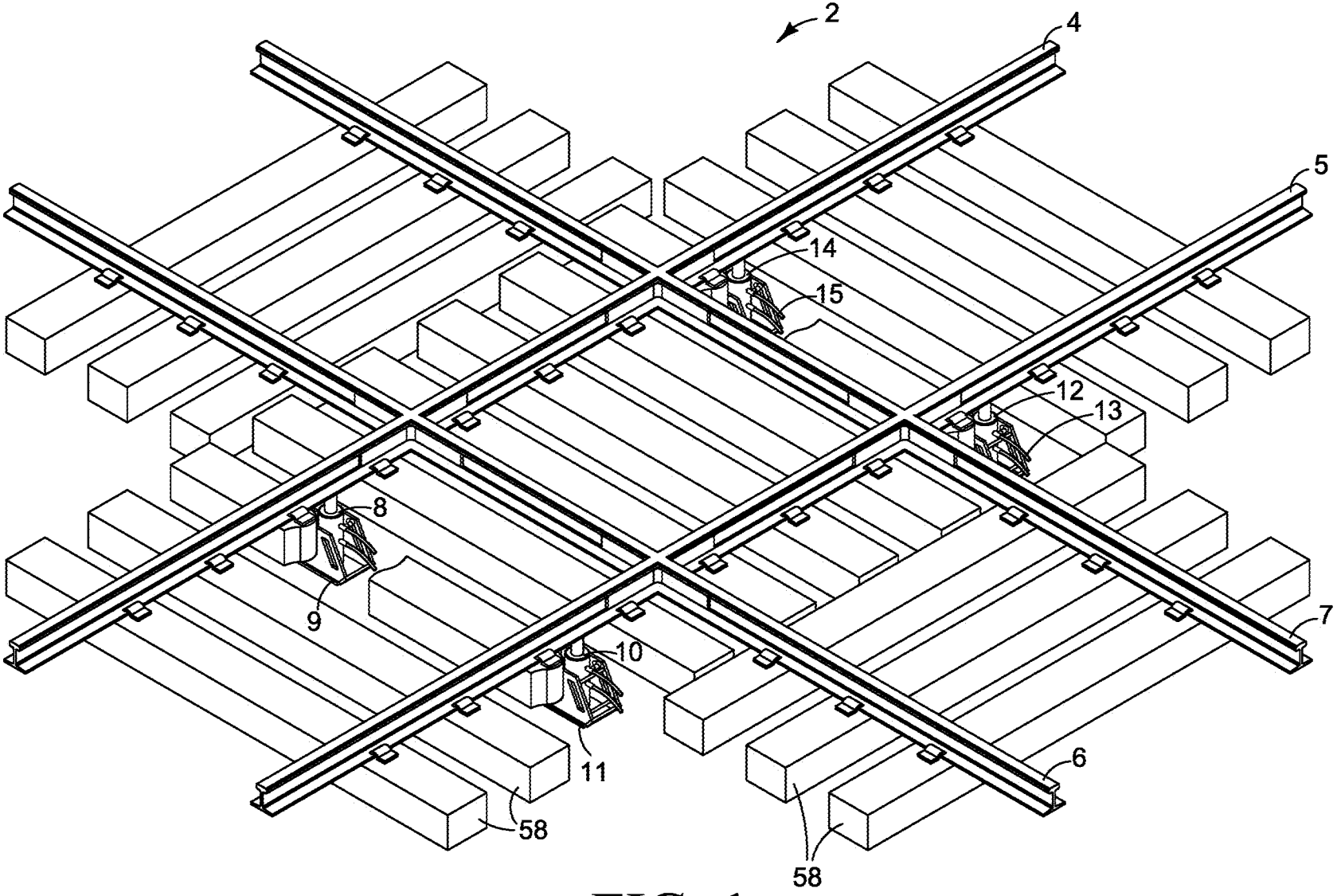
FIG. 1 is a perspective view of a railroad structure with four hydraulic jacks positioned and configured to lift the structure.

While the presently disclosed inventive concept(s) is susceptible of vanous modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

FIG. 1 is a diagram of a typical railroad structure, namely a diamond, having four hydraulic jacks positioned to lift the structure. The jacks are illustrated through cutout ties (the ties are typically left in full in use). Typical railroad structures include diamonds, double crossover turnouts, switches, and frogs. In these structures multiple railroad tracks cross, merge, or one track diverges into two. The structures tend to sink more than the single tracks leading to the structure from the added weight of trains from each single track crossing the structure, as opposed to the reduced traffic on each single track. The sinkage results from the breakdown and/or compression of the ballast beneath the structure. FIG. 1 illustrates a diamond 2 formed by the intersection of a first track formed by rails 4, 5, a second track formed by rails 6, 7, and associated ties, e.g. 58. The method, apparatus and system disclosed herein has been deemed useful to raise a single structure, or if configured properly to lift multiple structures simultaneously to allow for leveling of multiple adjacent structures.

A first step in the process is to excavate an opening beneath each rail selected for lifting. Alternatively, a tie can be removed leaving an opening or void. A hydraulic jack is then positioned within each opening. FIG. 1 illustrates four hydraulic jacks 8, 10, 12, 14 each positioned within an opening beneath a rail. In a preferred embodiment the hydraulic jacks are rated for sixty-two (62) ton capacity. Preferably each hydraulic jack is positioned on a sled, 9, 11, 13, 15 detailed below, that allows for sliding of the jack into and out of the opening. Four hydraulic jacks are shown positioned for lifting the structure, although additional or fewer jacks may be utilized depending on the structure. The hydraulic jacks are preferably connected to a manifold (not shown) that are attached to a hydraulic pump. Alternatively a hydraulic pump can be utilized for each jack, or a combination of jacks and pumps. Preferably each jack is operated independently (selectively) so as to control the lift in each area of the structure being lifted. The individual operation of each of the jacks allows for the coordinated lifting and lowering of each jack on each side of the structure until the structure is level or crowned.

Figure 2:
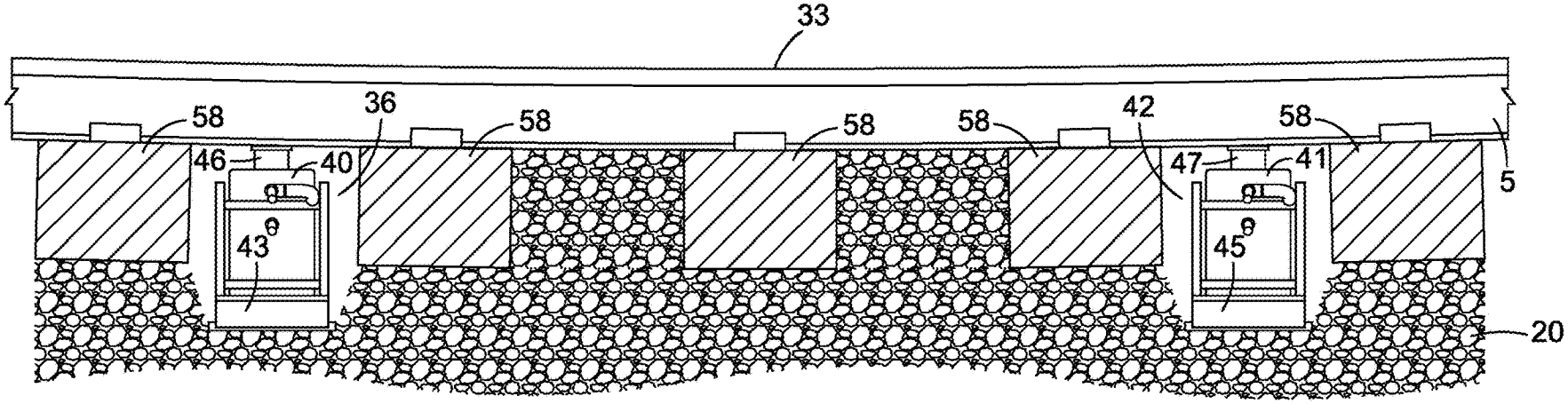
FIG. 2 is a side cutaway view of a railway having two hydraulic jacks positioned and configured to lift the railway.
Figure 3:
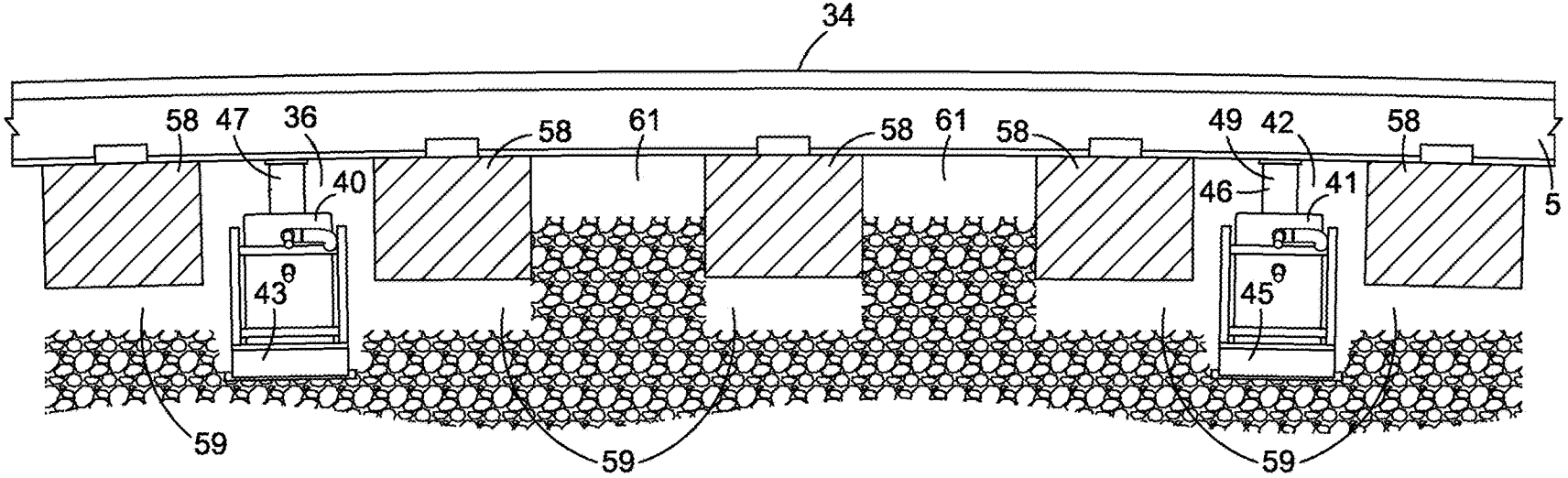
FIG. 3 is the side cutaway view of FIG. 2 with the hydraulic jacks extended to lift the railway.

FIGS. 2 and 3 illustrate a cutaway view of a railroad before and after raising the rail and attached ties with hydraulic jacks. FIG. 2 illustrates the depressed 33 rail 5 and associated ties 58. Openings 36, 42 have been excavated with jacks 40, 41 positioned on sleds 43, 45 and slid into the excavated openings. The saddle 46, 47 of each jack is positioned beneath the rail so as to be able to lift the rail away from the ballast 20. When actuated, piston 49 lifts the rail away from ballast 20.

FIG. 3 illustrates a cutaway of the rail of FIG. 2 in which the hydraulic jacks 40, 41 have been extended. Extension of hydraulic jacks has lifted the rail 5 and attached ties 58 away from the ballast 20 providing for gaps 59 beneath the ties 58 as well as gaps 61 beneath the rails. A crown 34 is shown in the rail 5. Subsequently a tamping machine travels down the rail line with the jacks left in place. The tamping machine tamps ballast material under the railroad ties thus providing a lift to the railroad section and structure. Preferably the jacks are positioned with a valve so as to allow detachment of the hydraulic lines from each jack to allow the jacks to remain in place. Alternatively, the jacks can be removed and the ballast filled into the voids left by the removal of the jacks.

Figure 4:
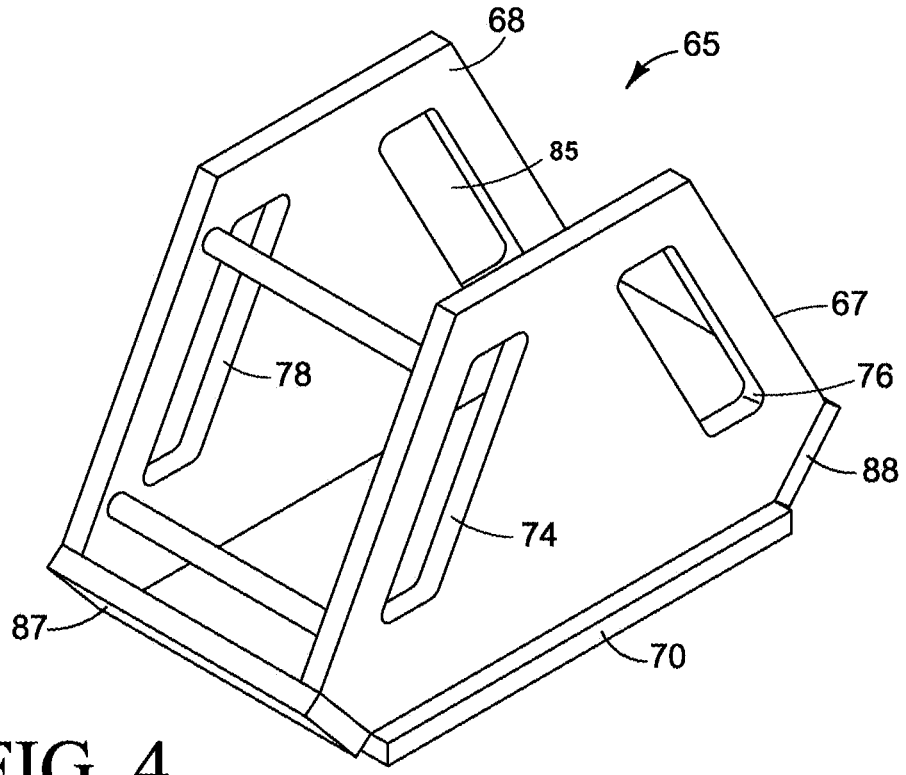
FIG. 4 is a perspective view of a hydraulic jack sled.
Figure 5:
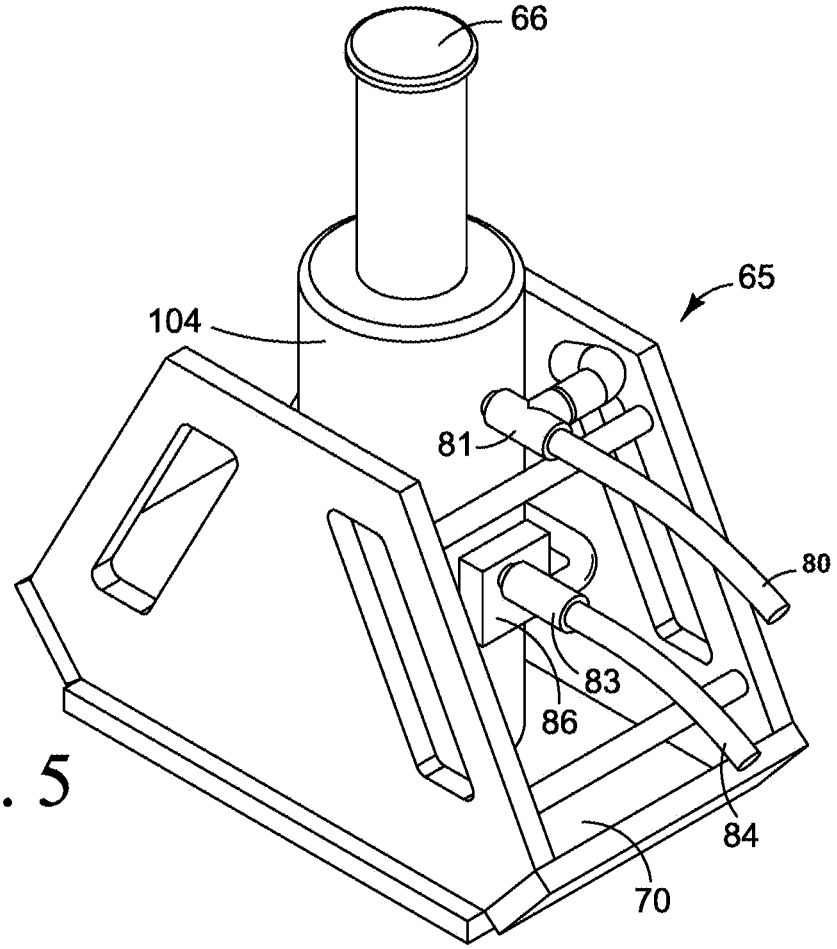
FIG. 5 is a perspective view of a hydraulic jack sled with a hydraulic jack positioned on the sled.

FIGS. 4 and 5 illustrate perspective views of a preferred embodiment of a hydraulic jack and hydraulic jack sled. FIG. 4 illustrates the hydraulic jack sled without a hydraulic jack positioned in the sled. FIG. 5 illustrates a hydraulic jack 66 having a body 104 positioned in a hydraulic jack sled 65. The sled has a flat bottom 70 to facilitate sliding the hydraulic jack sled into an opening beneath a railway. The sled preferably has opposing handholds 76, 85 and 74, 78 positioned in opposing sidewalls 67, 68 for grasping the jack sled and manipulating the jack sled and jack into and out of position beneath a rail of a railroad track. The sled has angled plates (87 and 88) to aide in installation and removal during jack placement. Hydraulic lines 80, 84 connected to upper 81 and lower 83 connections provide an inflow and a return hydraulic connection between the jack and the hydraulic pump and reservoir. Check valve 86 allows for maintaining the jack in an extended, supported position when the hydraulic lines are disconnected.

Figure 6:
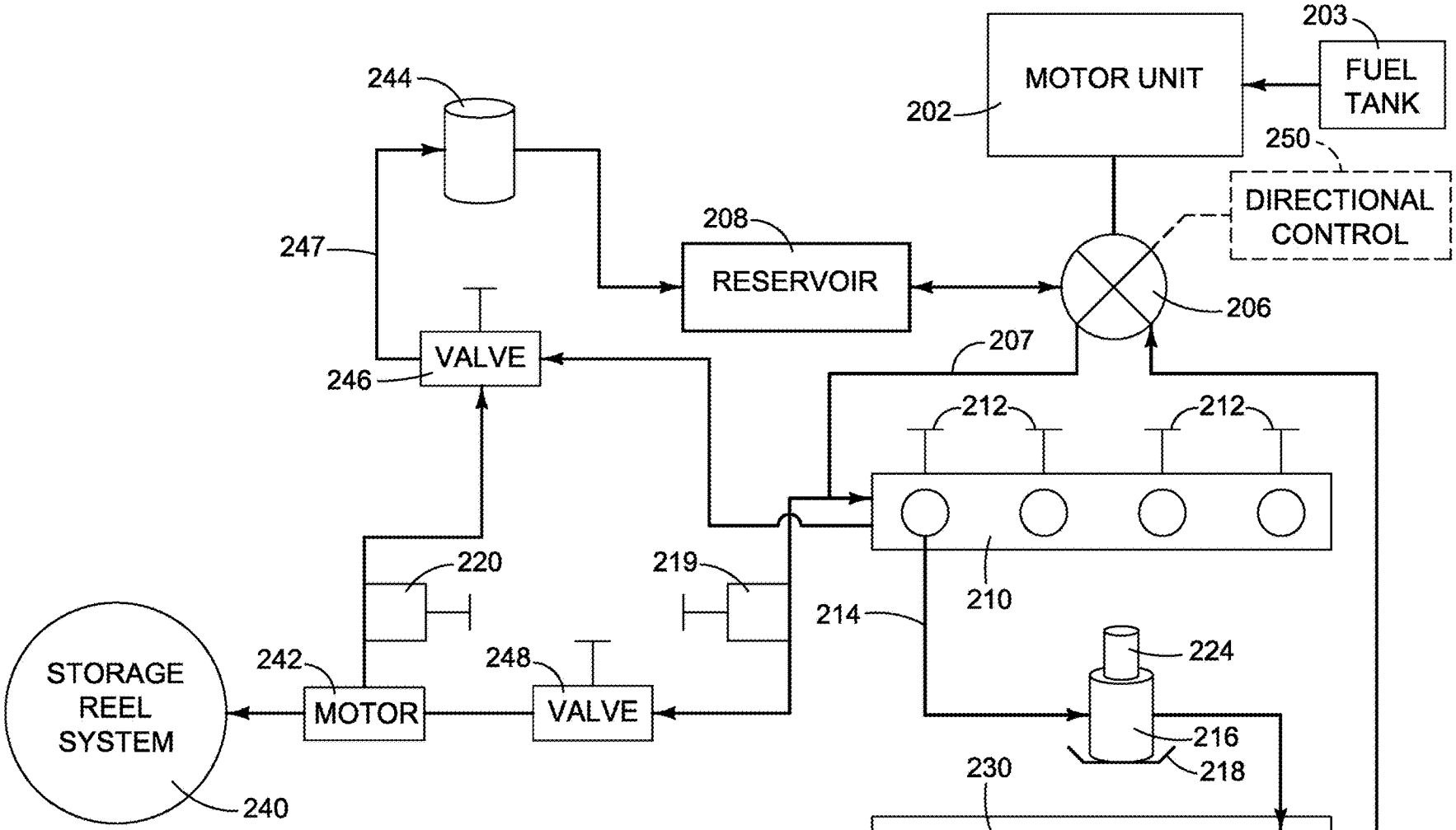
FIG. 6 is a diagram of a system for use in raising railroad structures for ballast repair and replacement.

FIG. 6 illustrates a block diagram of a hydraulic jacking system having a motor 202 that drives a hydraulic pump 206 with directional control 250. A fuel tank 203 provides fuel to the motor. A reservoir 208 provides hydraulic fluid to the hydraulic pump and stores return hydraulic fluid from the return manifold 230. A primary manifold 210 is in fluid connection 207 with the pump. The manifold can be either located proximate or on the frame or alternatively remote from the frame. The manifold has a series of valves 212 configured to selectively activate the hydraulic circuit to a hydraulic jack. The hydraulic circuit provides hydraulic fluid to the hydraulic jack via line 214 and returns hydraulic fluid to a return manifold 230 via inflow ports 231. Hydraulic fluid is returned from the sub manifold to the reservoir via a valve (not illustrated). The hydraulic jack 216 is preferably positioned on a sled 218. The saddle of the jack 224 is configured to lift the rail of the railroad structure. The jack is positioned to lift a railroad structure such that ballast can be placed beneath the elevated railroad structure to raise the structure, such as to level or place a crown in the structure.

A hydraulic reel 240 is provided for retracting the hydraulic line(s) to the jack(s). The reel is operated by a motor 242. A valve 219 is opened to allow fluid to pressurize the hose reel circuit and is selectively actuated from the hydraulic pump to supply hydraulic fluid to the motor of the storage reel. To actuate the directional control of the hose reel, motor valve 248 is moved in or out to either retract or extend the hose(s). To deactivate the hydraulic reel 240 and manifolds, a valve 246 is opened, allowing fluid to flow 247 through a filter 244 and to the reservoir 208. To control the flow and speed of the hose reel, valve 220 is adjusted to desired speed.

Figure 7:
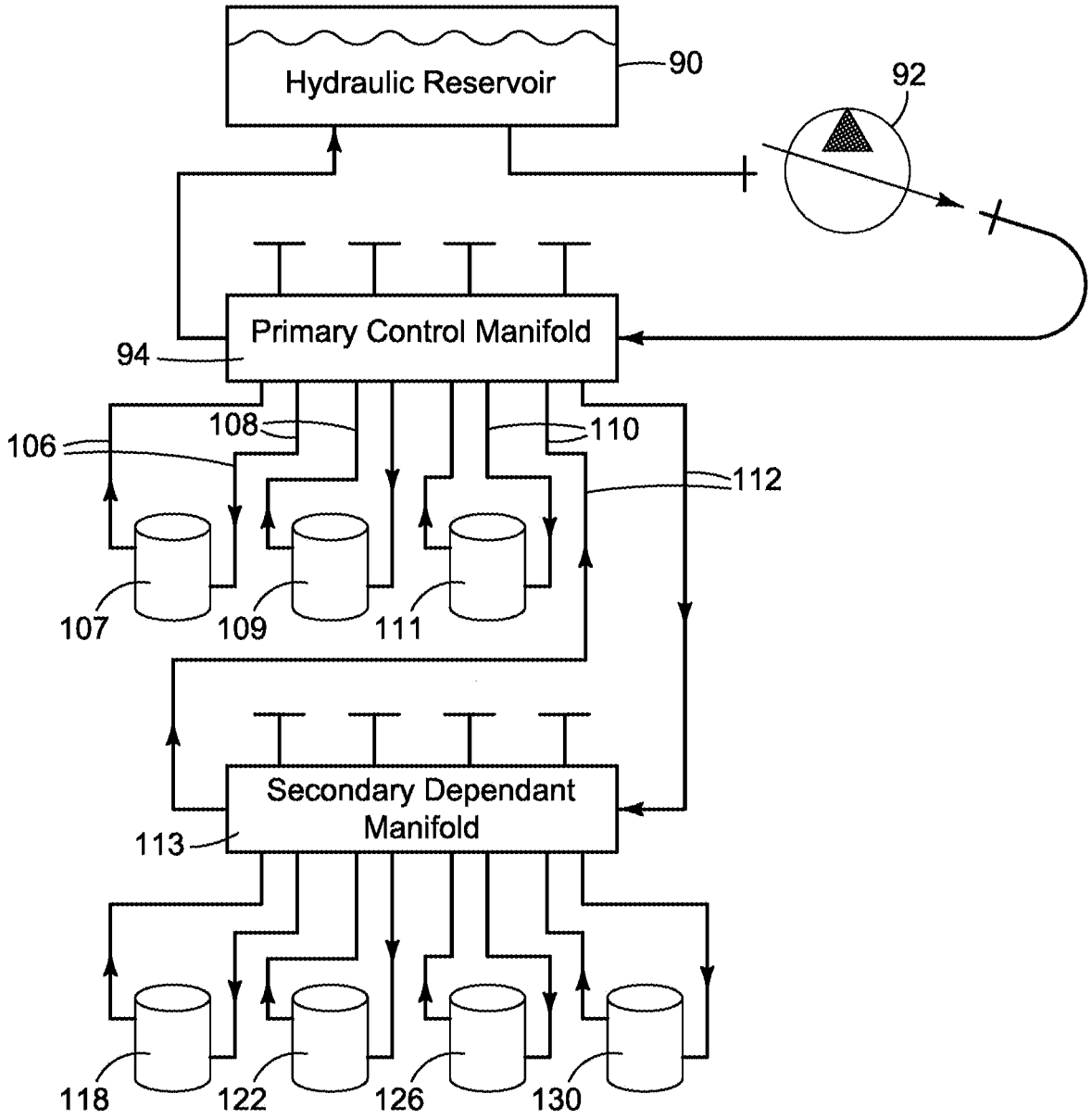
FIG. 7 is a diagram illustrating a example of a series of hydraulic circuits utilized to operate a plurality of hydraulic jacks according to preferred embodiments of the invention.

FIG. 7 illustrates a preferred embodiment of fluid connection circuits between a hydraulic reservoir 90, pump 92, first manifold 94, hydraulic jacks 107, 109, 111 and a secondary dependent manifold 113 that supplies hydraulic fluid to jacks 118, 122, 126, and 130. Each of the primary control manifold circuits 106, 108, 110, and 112 provides a hydraulic fluid supply and return. The return is connected typically to a sub manifold that accepts fluid return and is valve operated to return the fluid to the reservoir. Circuit 112 provides fluid to a secondary (such as a remote) manifold. Utilization of a remote manifold allows for a single hydraulic line to extend a distance from the pump and selectively operate more than one hydraulic jack.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A method of raising a railroad structure, the railroad structure being formed by an intersection, diversion, or merging of two or more railways, the method comprising the steps of:

a. excavating an opening beneath a railway forming a portion of the railroad structure, wherein the opening is configured to provide for positioning a hydraulic jack beneath the railway to lift the railway;

b. placing a hydraulic jack that is operated by a hydraulic pump into the opening beneath the railway, wherein the hydraulic jack is positioned beneath a rail of the railway in such a position that continued use of the railway by a train is facilitated;

c. repeating step a. and step b. on the railways forming the railroad structure with additional hydraulic jacks until sufficient hydraulic jacks have been positioned beneath rails operatively connected to the railroad structure to raise the railroad structure, wherein each of the hydraulic jacks is hydraulically coupled to the hydraulic pump;

d. operating the hydraulic pump to raise the hydraulic jacks and thus raise the railroad structure into a raised position in which continued use of the railroad structure by the train is facilitated while the hydraulic jacks remain in position beneath the rails;

e. moving a tamping machine onto the railroad structure via the rails and operating the tamping machine from above the railroad structure to add and tamp ballast beneath the railroad structure while the hydraulic jacks remain in said position beneath the rails.

2. The method of claim 1, further comprising removing the hydraulic jacks and replenishing ballast in the opening associated with each of the hydraulic jacks.

3. The method of claim 1, wherein the hydraulic jacks are connected by hydraulic lines to at least one manifold configured for selective actuation of each of the hydraulic jacks.

4. The method of claim 1, wherein the opening is excavated by removing a railroad tie from the railway, and further comprising after step e . . . removing the hydraulic jack, the steps of replacing the railroad tie in the opening, and replenishing the ballast beneath the railroad tie.

5. The method of claim 1, wherein at least one of the hydraulic jacks comprise a check valve configured to allow for disconnection of the hydraulic jacks from hydraulic connection with a manifold while retaining the hydraulic jacks in a lifted position beneath the railway, wherein the method comprises disconnecting at least one of the hydraulic jacks from the hydraulic connection with the manifold.

6. The method of claim 1, wherein at least one of the hydraulic jacks is positioned on a hydraulic jack sled having a smooth bottom surface that facilitates sliding installation and removal of the hydraulic jack sled, and wherein step b. comprises sliding the hydraulic jack sled into the opening beneath the railway.

7. The method of claim 1, further comprising before step e., checking a level of the railroad structure from above the rails while the hydraulic jacks remain in said position beneath the rails and repeating step d. until the railroad structure is a desired level.

8. The method of claim 1, further comprising step f. of checking the level of the railroad structure from above the rails while the hydraulic jacks remain in said position beneath the rails and repeating steps d. and e until the railroad structure is a desired level.

9. The method of claim 1, further comprising before step e., connecting ends of hydraulic lines connected to the hydraulic jacks together to prevent debris from entering the hydraulic lines.

* * * * *